US010839970B2

(12) United States Patent
Hida et al.

(10) Patent No.: US 10,839,970 B2
(45) Date of Patent: Nov. 17, 2020

(54) SPENT NUCLEAR FUEL ASSEMBLY STORAGE CONTAINER AND ASSEMBLY OF SPENT NUCLEAR FUEL ASSEMBLY STORAGE CONTAINERS

(71) Applicants: WATS Co., Ltd., Tsuruga (JP); IHI Construction Materials Co., Ltd., Sumida-ku (JP); MURATA ENGINEERING Co., Ltd., Izumi (JP)

(72) Inventors: Yoshio Hida, Tsuruga (JP); Hiroaki Kato, Tokyo (JP); Takashi Murata, Osaka (JP); Masakatsu Uehara, Tokyo (JP)

(73) Assignees: WATS Co., Ltd., Tsuruga (JP); IHI Construction Materials Co., Ltd., Sumida-ku (JP); MURATA ENGINEERING Co., Ltd., Izumi (JP)

( * ) Notice: Subject to any disclaimer, the term of this patent is extended or adjusted under 35 U.S.C. 154(b) by 481 days.

(21) Appl. No.: 15/569,296

(22) PCT Filed: Apr. 26, 2016

(86) PCT No.: PCT/JP2016/063023

§ 371 (c)(1),
(2) Date: Oct. 25, 2017

(87) PCT Pub. No.: WO2016/175197

PCT Pub. Date: Nov. 3, 2016

(65) Prior Publication Data

US 2018/0130566 A1 May 10, 2018

(30) Foreign Application Priority Data

Apr. 28, 2015 (JP) ..... 2015-092233

(51) Int. Cl.

| | |
|---|---|
| ***G21F 9/30*** | (2006.01) |
| ***G21F 9/36*** | (2006.01) |
| ***G21F 5/005*** | (2006.01) |
| ***G21F 5/10*** | (2006.01) |
| ***G21F 5/008*** | (2006.01) |
| ***G21F 5/06*** | (2006.01) |
| ***G21F 9/34*** | (2006.01) |

(52) U.S. Cl.

CPC ..... *G21F 9/304* (2013.01); *G21F 5/005* (2013.01); *G21F 5/008* (2013.01); *G21F 5/06* (2013.01); *G21F 5/10* (2013.01); *G21F 9/34* (2013.01); *G21F 9/36* (2013.01)

(58) Field of Classification Search

CPC . G21F 9/30; G21F 9/304; G21F 5/008; G21F 5/06; G21F 9/34

USPC ..... 588/1

See application file for complete search history.

(56) References Cited

U.S. PATENT DOCUMENTS

| | | | |
|---|---|---|---|
| 5,668,843 | A | 9/1997 | Wasinger |
| 6,064,711 | A | 5/2000 | Copson |
| 6,718,000 | B2 | 4/2004 | Singh et al. |
| 7,474,726 | B2 | 1/2009 | Hempy et al. |
| 8,006,841 | B2 | 8/2011 | Bontemps et al. |
| 2008/0031396 | A1 | 2/2008 | Singh et al. |
| 2014/0177776 | A1 | 6/2014 | Singh |

FOREIGN PATENT DOCUMENTS

| | | | |
|---|---|---|---|
| CN | 1734682 | A | 2/2006 |
| CN | 204667894 | U | 9/2015 |
| EP | 0741904 | B1 | 3/1998 |
| JP | 61-52299 | U | 4/1986 |
| JP | 2-287197 | A | 11/1990 |
| JP | 3-81597 | U | 8/1991 |
| JP | 11-84068 | A | 3/1999 |
| JP | 2000-221294 | A | 8/2000 |
| JP | 2001-4792 | A | 1/2001 |
| JP | 2002-318298 | A | 10/2002 |
| JP | 2003-167094 | A | 6/2003 |
| JP | 2004-28939 | A | 1/2004 |
| JP | 2004-233055 | A | 8/2004 |
| JP | 2007-10527 | A | 1/2007 |
| JP | 5205540 | B1 | 6/2013 |
| JP | 2013-152164 | A | 8/2013 |
| JP | 2014-141384 | A | 8/2014 |
| JP | 3192884 | U | 9/2014 |
| JP | 2015-125141 | A | 7/2015 |
| TW | 1430287 | B | 3/2014 |
| TW | I430287 | B | 3/2014 |
| TW | 201545171 | A | 12/2015 |
| WO | 2004/017331 | A1 | 2/2004 |

OTHER PUBLICATIONS

Taiwanese Office Action dated Mar. 17, 2020, in Patent Application No. 105134528, 8 pages. (with English translation of Search Report).

International Search Report dated Jul. 19, 2016, in PCT/JP2016/063023. filed Apr. 26, 2016.

Office Action dated Apr. 19, 2016, in Japanese Patent Application No. 2015-092233, filed Apr. 28, 2015. (with English translation).

Combined Office Action and Search Report dated Nov. 13, 2018 Chinese Patent Application No. 201680024235.1, 14 pages (with English translation).

Jian, T. et al. "Current Situation and Development Trend of Radiation Cement" Solid Waste Treatment and Disposal, 2014, pp. 119-122 (with English abstract).

*Primary Examiner* — Edward M Johnson

(74) *Attorney, Agent, or Firm* — Oblon, McClelland, Maier & Neustadt, L.L.P.

(57) ABSTRACT

The present invention provides a spent nuclear fuel assembly storage including a metal cask which stores a spent nuclear fuel assembly and a container body which stores the metal cask and has a substantially hexagonal tubular shape, and an assembly of the spent nuclear fuel assembly storage containers, and a method of assembling the spent nuclear fuel assembly storage container.

11 Claims, 9 Drawing Sheets

SPENT NUCLEAR FUEL ASSEMBLY STORAGE CONTAINER AND ASSEMBLY OF SPENT NUCLEAR FUEL ASSEMBLY STORAGE CONTAINERS

TECHNICAL FIELD

The present invention relates to a spent nuclear fuel assembly storage container which stores a metal cask storing a spent nuclear fuel assembly, an assembly of the spent nuclear fuel assembly storage containers, and a method of assembling the spent nuclear fuel assembly storage container.

Priority is claimed on Japanese Patent Application No. 2015-092233, filed Apr. 28, 2015, the content of which is incorporated herein by reference.

BACKGROUND ART

Conventionally, as a storage container which safely stores radioactive contaminants, for example, storage containers disclosed in Patent Documents 1 and 2 are known. Regarding the storage container disclosed in Patent Document 1, radioactive waste is stored in a cast metal container and cast metal containers containing radioactive waste are stacked and stored. Further, regarding the radioactive contaminant storage container disclosed in Patent Documents 2, a concave portion or a convex portion is formed on each outer surface of a substantially hexagonal prism container containing radioactive contaminants within a storage space. When arranging radioactive contaminant storage containers, a convex portion of a second storage container is fitted into a concave portion of a first storage container and the outer surfaces of the substantially hexagonal prism containers are brought into contact with each other, such that they have a honeycomb structure. In this way, radioactive contaminants are stored.

In contrast, unlike radioactive contaminants, spent nuclear fuel assemblies used in a reactor have a high temperature of, for example, 300° C. or more immediately after use. For that reason, spent nuclear fuel assemblies are stored in a pool of water for about 3 to 5 years and then stored in a dry storage container in a state where the ambient temperature thereof is, for example, 100° C. or less.

As a dry storage container, for example, a substantially cylindrical metal cask storing a fuel assembly to which spent nuclear fuel rods are connected is known. Metal casks are in a high temperature state since nuclear fuel assemblies stored therein are reacting even when they are stored in water. For that reason, such metal casks storing nuclear fuel assemblies are stored in a strong building having earthquake resistance and a radiation shielding capability while having gaps therebetween or being laid horizontally.

Further, as another dry storage means, a substantially cylindrical concrete cask having a shielding capability is known. These concrete casks storing nuclear fuel assemblies are arranged with gaps therebetween in an outdoor space.

In Japan, the amount of the radiation at a site boundary needs to be limited to an allowable value of 1 mSv or less per year when storing spent nuclear fuel assemblies. Here, a storage method of storing metal casks in a building shielding radiation is selected in consideration of constraints such as the size of the site.

CITATION LIST

Patent Document

[Patent Document 1]
Japanese Unexamined Patent Application, First Publication No. 2003-167094
[Patent Document 2]
Japanese Patent No. 5205540

SUMMARY OF INVENTION

Technical Problem

However, due to the spent nuclear fuel assemblies reacting, the metal casks also have a high temperature. Thus, it is difficult to store the metal casks in hermetically sealed storage containers when the metal casks are in contact with each other like for the radioactive contaminants disclosed in Patent Documents 1 and 2. Further, when metal casks storing spent nuclear fuel assemblies are stored and distributed in a building having earthquake resistance and a shielding capability, costs are high. In addition, it takes costs to obtain a site for the building.

The present invention has been made in view of such circumstances and an object of the present invention is to provide spent nuclear fuel assembly storage containers capable of storing spent nuclear fuel assemblies while being packed together and allowing cooling of metal casks without requiring a building having a high shielding capability, an assembly of the spent nuclear fuel assembly storage containers, and a method of assembling the spent nuclear fuel assembly storage container.

Further, another object of the present invention is to provide a spent nuclear fuel assembly storage container having a sufficient shielding capability and impact resistance to improve radiation shielding performance, an assembly of the spent nuclear fuel assembly storage containers, and a method of assembling the spent nuclear fuel assembly storage container.

Solution to Problem

According to a first aspect of the present invention, there is provided a spent nuclear fuel assembly storage container including: a metal cask which stores a spent nuclear fuel assembly therein; a container body which stores the metal cask and has a substantially hexagonal tubular shape; and a concave portion which is formed on an outer surface of the container body having the substantially hexagonal tubular shape, is recessed inward, and extends in a longitudinal direction, wherein the concave portion forms an external cooling passage for a cooling gas when an outer surface of the container body is joined to an outer surface of another container body.

According to the first aspect of the present invention, a container body having a high radiation shielding capability and impact resistance and storing a metal cask can be stored in an outdoor place. In addition, the spent nuclear fuel assembly storage containers can store spent nuclear fuel assemblies while being packed together to form a honeycomb structure when the outer surfaces of the container bodies each having a substantially hexagonal tubular shape are in contact with each other. In addition, since the concave portion formed in any one of the outer surfaces of the container body is provided with an external cooling passage through which external air flows, the metal cask can be cooled. Therefore, an increase in temperature of the metal cask can be inhibited.

According to a second aspect of the present invention, there is provided a spent nuclear fuel assembly storage container including: a metal cask which stores a spent nuclear fuel assembly; a container body which stores the metal cask and has a substantially hexagonal tubular shape; and an internal cooling passage which is provided between the metal cask and an inner surface of the container body and is provided with a cooling gas supply passage and an exhaust passage communicating with external air at upper and lower portions thereof.

According to the second aspect of the present invention, the container body having high radiation shielding capability and impact resistance and storing the metal cask can be stored in an outdoor place. In addition, spent nuclear fuel assembly storage containers can store the spent nuclear fuel assemblies in an accumulation state to form a honeycomb structure while the outer surfaces of the container bodies each having a substantially hexagonal tubular shape come into contact with each other. In addition, since external air flows through the internal cooling passage between the metal cask and the inner surface of the container body, the metal cask can be cooled. Therefore, an increase in temperature of the metal cask can be suppressed.

According to a third aspect of the present invention, there is provided the spent nuclear fuel assembly storage container of the first or second aspect, wherein an inner surface of the container body is provided with a stopper which prevents vibration of the metal cask.

According to the third aspect of the present invention, it is possible to prevent a collision with the container body due to vibration of the metal cask by the use of a stopper even when vibration occurs due to earthquakes or the like when installing the spent nuclear fuel assembly storage container on an outdoor ground.

According to a fourth aspect of the present invention, there is provided the spent nuclear fuel assembly storage container according to any one of the first to third aspects, wherein an upper surface of the container body is provided with a tapered chimney.

According to the fourth aspect of the present invention, since the upper surface of the container body is provided with the tapered chimney, a gas exchanging heat with the metal cask in the external cooling passage or the internal cooling passage can be discharged from the upper surface and flows through the tapered chimney. Accordingly, since the flow speed of the gas in the external cooling passage or the internal cooling passage becomes high, the metal cask cooling effect can be promoted.

According to a fifth aspect of the present invention, there is provided a spent nuclear fuel assembly storage container including: a metal cask which stores a spent nuclear fuel assembly; and a container body which stores the metal cask and has a substantially hexagonal tubular shape, wherein the container body is made of neutron shielding concrete including an aggregate mainly including colemanite and/or hilgardite collected from an ore of an evaporation type sedimentary deposit and a cement which is a consolidating material and is manufactured by mixing the cement with the colemanite and/or hilgardite as an aggregate excluding ulexite and sassolite contained in the ore of the evaporation type sedimentary deposit.

According to the fifth aspect of the present invention, radiation such as neutron radiation emitted from the nuclear fuel assembly through the metal cask can be shielded by neutron shielding concrete forming the container body. For that reason, the amount of radiation emitted from the spent nuclear fuel assembly storage container to the external environment can be reduced to within allowable values.

According to a sixth aspect of the present invention, there is provided the spent nuclear fuel assembly storage container according to any one of the first to fourth aspects, wherein the container body is made of heavy-weight concrete having a specific gravity of 3.5 or more.

According to the sixth aspect of the present invention, radiation such as neutron rays emitted from the nuclear fuel assembly through the metal cask can be shielded by concrete having a high specific gravity and forming the container body. For that reason, the amount of the radiation emitted from the spent nuclear fuel assembly storage container to the external environment can be reduced within an allowable value.

According to a seventh aspect of the present invention, there is provided an assembly of spent nuclear fuel assembly storage containers in which spent nuclear fuel assembly storage containers each including a metal cask storing a spent nuclear fuel assembly and a container body storing the metal cask and having a substantially hexagonal tubular outer surface are arranged, wherein the container bodies are arranged to have a honeycomb structure when the outer surfaces are brought into contact with each other, and wherein a space without the spent nuclear fuel assembly storage container is provided in such a manner that at least one outer surface of each of the container bodies is in contact with external air.

According to the seventh aspect of the present invention, since at least one outer surface of each container body faces a space without the spent nuclear fuel assembly storage container in the spent nuclear fuel assembly storage containers arranged in an accumulation state to have a honeycomb structure, the metal cask inside the container body can be cooled by external air flowing through the space.

According to an eighth aspect of the present invention, there is provided an assembly of spent nuclear fuel assembly storage containers in which spent nuclear fuel assembly storage containers each including a metal cask storing a spent nuclear fuel assembly and a container body storing the metal cask and having a substantially hexagonal tubular outer surface are arranged, wherein the container bodies are arranged to have a honeycomb structure while the outer surfaces are brought into contact with each other, and wherein container bodies not storing metal casks are arranged at a further outside of the spent nuclear fuel assembly storage containers arranged at an outside of the spent nuclear fuel assembly storage containers.

According to the eighth aspect of the present invention, the radiation emitted from the metal casks inside the spent nuclear fuel assembly storage containers is shielded by the wall surfaces of the container bodies of other spent nuclear fuel assembly storage containers so that the radiation amount can be reduced within an allowable value. Part of the radiation is emitted to the outside, but is shielded while passing through the empty container bodies not storing metal casks. Thus, the radiation amount can be reduced within an allowable value. In addition, the cooling effect can be improved.

According to a ninth aspect of the present invention, there is provided a method of assembling a spent nuclear fuel assembly storage container, including: installing a base; placing a metal cask storing a spent nuclear fuel assembly onto the base; and fixing the metal cask to the base by covering the metal cask using a member with a lid portion and a side cylindrical portion having a substantially hexagonal tubular shape.

According to the ninth aspect of the present invention, the metal cask placed on the base is fixed while being covered by the member with the lid portion and the side cylindrical portion having a substantially hexagonal tubular shape. Accordingly, the spent nuclear fuel assembly storage container can be assembled with a small number of steps.

Advantageous Effects of Invention

According to the spent nuclear fuel assembly storage container of the present invention, it is possible to reduce the amount of the radiation emitted to the outside with the container body covering the metal cask and to directly or indirectly cool the metal cask stored in the container body by causing cooling gas to flow through the external cooling passage formed by the concave portion of the outer surface of the container body or the internal cooling passage formed between the metal cask and the inner surface of the container body.

For that reason, even a metal cask storing a spent nuclear fuel assembly can be stored in the container body and the spent nuclear fuel assemblies can be stored while the container bodies are accumulated in such a manner that the outer surfaces of the container bodies come into contact with each other.

Further, in the method of assembling the spent nuclear fuel assembly storage container, the assembly of the metal cask and the container body and the storage of the metal cask can be simply performed.

Further, according to the spent nuclear fuel assembly storage container of the present invention, since the container body made of neutron shielding concrete using colemanite and/or hilgardite as an aggregate can shield radiation such as neutron rays emitted from a nuclear fuel assembly through the metal cask, the amount of the radiation emitted to the outside can be reduced.

Further, according to the assembly of the spent nuclear fuel assembly storage containers of the present invention, since the spent nuclear fuel assembly storage containers are arranged to have a honeycomb structure while the outer surfaces of the substantially hexagonal tubular container bodies come into contact with each other, many storage containers can be arranged in a space occupying a small area.

Further, since the amount of the radiation emitted to the outside can be reduced to an allowable value or less by the container body covering the metal cask and at least one outer surface of the spent nuclear fuel assembly storage containers arranged to have a honeycomb structure contacts external air, the metal cask inside each spent nuclear fuel assembly storage container can be cooled even in the assembly with the honeycomb structure.

Further, since the amount of the radiation emitted to the outside can be reduced to an allowable value or less by the container body covering the metal cask and the empty container bodies not storing the metal casks are arranged at the further outside of the spent nuclear fuel assembly storage containers arranged at the outside of the spent nuclear fuel assembly storage containers, the amount of the radiation emitted to the outside can be reduced to an allowable value or less and the cooling effect can be improved.

DESCRIPTION OF EMBODIMENTS

Hereinafter, a spent nuclear fuel assembly storage container according to a first embodiment of the present invention and an assembly thereof will be described.

Figure 1:
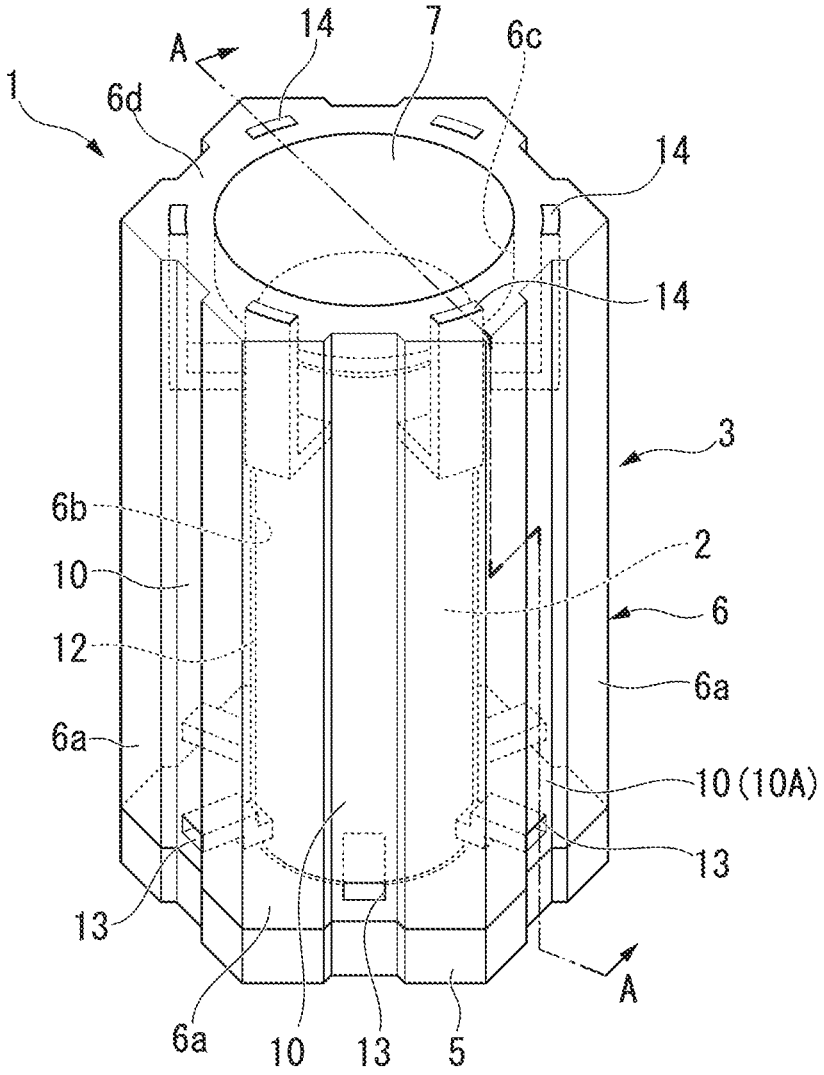
FIG. 1 is a perspective view showing a spent nuclear fuel assembly storage container according to a first embodiment of the present invention.
Figure 2:
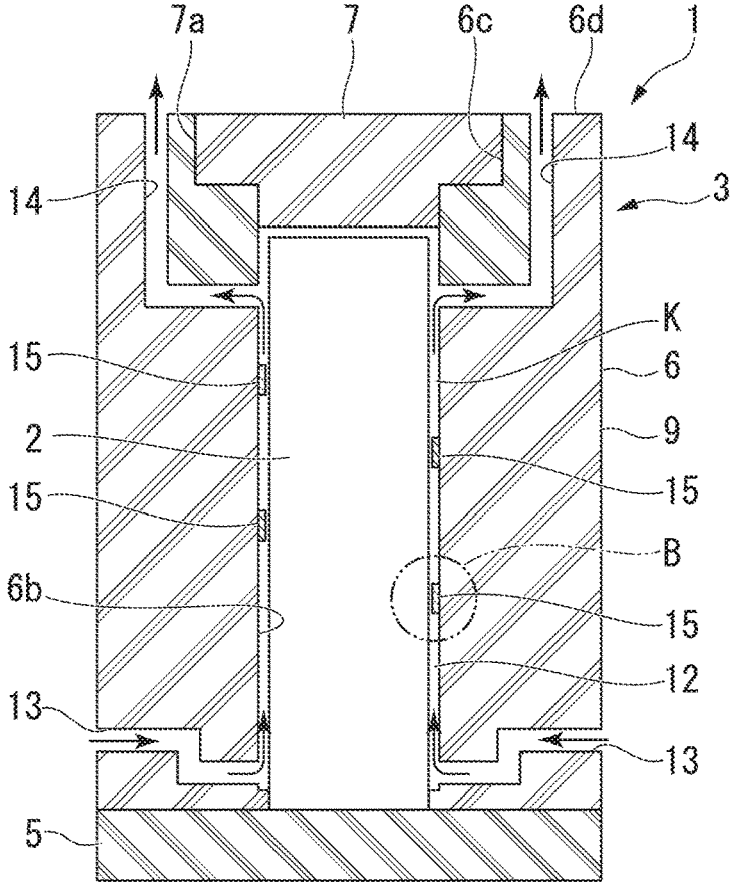
FIG. 2 is a longitudinal sectional view taken along a line A-A of the spent nuclear fuel assembly storage container shown in FIG. 1.

A spent nuclear fuel assembly storage container 1 shown in FIGS. 1 and 2 has a configuration in which a metal cask 2 storing a spent nuclear fuel assembly corresponding to an assembly of fuel rods having finished a reaction inside a nuclear reactor is stored inside a container body 3 made of concrete and having a substantially hexagonal tubular shape. The metal cask 2 storing the spent nuclear fuel assemblies has a substantially cylindrical shape. The spent nuclear fuel assembly storage container of the present invention can efficiently store the assembly of spent nuclear fuel assembly storage containers 1 in a small occupied space regardless of whether the storage place is indoors or not.

In FIG. 1, the container body 3 of the spent nuclear fuel assembly storage container 1 includes a hexagonal plate-shaped base 5 on which the metal cask 2 is placed; a side cylindrical portion 6 of which an outer surface **6*a* is formed in a substantially hexagonal tubular shape and an inner surface 6*b* is formed in a substantially cylindrical shape, and a substantially disc-shaped lid portion 7 which is provided at an upper opening portion of the side cylindrical portion 6. The lid portion 7 is fitted to the upper opening portion 6*c* of the side cylindrical portion 6 and is integrally held as a hexagonal tube lid. The lid portion 7 can be separated from the side cylindrical portion 6** if necessary.

All of the base 5, the side cylindrical portion 6, and the lid portion 7 are made of concrete capable of shielding radiation such as neutrons emitted from the spent nuclear fuel assemblies. The container body 3 may be made of a material other than concrete as long as a radiation shielding capability can be exhibited.

In the side cylindrical portion 6 of the container body 3 shown in FIG. 2, the upper portion of the cylindrical inner surface 6*b* storing the metal cask 2 forms the stepped opening portion 6*c* opening upward in which the upper portion of the cylindrical inner surface 6*b* widens its diameter to serve a circular stepped shape. The disc-shaped lid portion 7 having a stepped outer peripheral surface is fitted to the opening portion 6*c* and is fixed to the upper portion of the side cylindrical portion 6 at an enlarged disc portion 7*a* of the lid portion 7 with bolts or the like. In addition, a joint portion between the base 5 and the side cylindrical portion 6 of the container body 3 also has a stepped shape similar to the fitting portion between the lid portion 7 and the opening portion 6*c* of the side cylindrical portion 6. Accordingly, radiation emitted from the metal cask 2 can be reliably shielded by the side cylindrical portion 6.

The side cylindrical portion 6 of the container body 3 includes six outer surfaces 6*a* which is similar to a rectangular hexagonal tube and each outer surface 6*a* includes a concave portion 10 formed at a center portion in the width direction. The concave portion 10 is formed along the entire length in the longitudinal direction from the lower end to the upper end of the center of the outer surface 6*a* and is formed to extend to each surface of the base 5. The concave portion 10 forms an external cooling passage 10A which is formed in the outer surface 6*a* of the container body 3 and through which external air passes. When external air flows along the concave portion 10 between the upper and lower sides in each outer surface 6*a*, the metal cask 2 can be cooled through the container body 3.

Further, the inner surface 6*b* of the side cylindrical portion 6 of the container body 3 is formed in a substantially cylindrical shape with a gap between the inner surface 6*b* and the metal cask 2 being formed.

An air supply passage 13 provided with an air supply port communicating with the outer surface 6*a* of the side cylindrical portion 6 is formed in the vicinity of the base 5 at the lower portion of the side cylindrical portion 6 to extend in the radial direction. The air supply passage 13 communicates with the lower end portion of the substantially cylindrical internal cooling passage 12. In addition, each air supply passage 13 provided in the side cylindrical portion 6 is bent radially in a stepped shape from the internal cooling passage 12, extends outward in the radial direction, and opens to the concave portion 10 of one of the six outer surfaces 6*a*. Accordingly, the radiation emitted from the metal cask 2 into the air supply passage 13 can be shielded by the wall surface of the side cylindrical portion 6.

Further, the upper portion of the internal cooling passage 12 in the side cylindrical portion 6 communicates with an exhaust passage 14 provided with an exhaust port which is formed to have a substantially L-shape in the cross-section inside the side cylindrical portion 6 and opens to the upper surface 6*d*. In addition, each exhaust passage 14 radially extends outward in the radial direction from the vicinity of the upper end of the internal cooling passage 12 and opens to the vicinity of one of the corner portions of the upper surface 6*d* formed in a hexagonal shape. The exhaust port of the exhaust passage 14 provided in the upper surface 6*d* may be located immediately above the air supply passage 13 and may be formed at an arbitrary position in the upper surface 6*d*. However, in this embodiment, the exhaust port of the exhaust passage 14 is formed in a thick corner portion.

Figure 3:
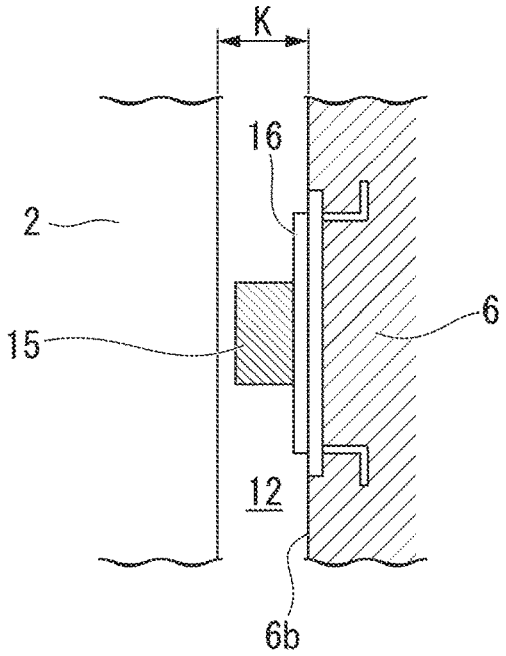
FIG. 3 is an enlarged cross-sectional view showing a part B between an inner surface of a container body and a metal cask shown in FIG. 2.

Further, in the internal cooling passage 12 inside the container body 3 shown in FIG. 2, stoppers 15 are attached to the inner surface 6*b* via an attachment member 16 in order to inhibit vibration of the metal cask 2 inside a gap K between the inner surface 6*b* and the metal cask 2 due to earthquakes or the like. As shown in FIG. 3, each of the stoppers 15 is preferably made of, for example, metal withstanding a high temperature and forms, for example, a minute gap of about 10 to 15 mm between each of the stoppers 15 and the metal cask 2.

In order to prevent a problem in which the metal cask 2 is vibrated and collides with the inner surface 6*b* of the side cylindrical portion 6, the stoppers 15 are preferably provided at predetermined intervals, for example, intervals of 90° in the circumferential direction on the inner surface 6*b* of the side cylindrical portion 6 and also have appropriate gaps therebetween in the vertical direction. Alternatively, the stoppers 15 may be arranged in a spiral shape along the inner surface 6*b*.

The spent nuclear fuel assembly storage container 1 according to this embodiment has the above-described configuration. Next, a method of assembling the spent nuclear fuel assembly storage container 1 will be described with reference to FIGS. 1 and 2.

Since the spent nuclear fuel assembly storage container 1 according to this embodiment is installed on, for example, an outdoor ground, the base 5 is provided on the ground. Then, the metal cask 2 is placed on the center of the base 5. Next, when the metal cask 2 is covered with the side cylindrical portion 6 having the lid portion 7 fitted thereto from above the metal cask 2, the metal cask 2 is surrounded by the container body 3 including the base 5, the side cylindrical portion 6, and the lid portion 7. Finally, when the side cylindrical portion 6 and the base 5 are fixed to each other with screws, the assembly of the spent nuclear fuel assembly storage container 1 is completed.

An operation of an assembly 18 using the spent nuclear fuel assembly storage containers 1 obtained in this way will be described.

Figure 4:
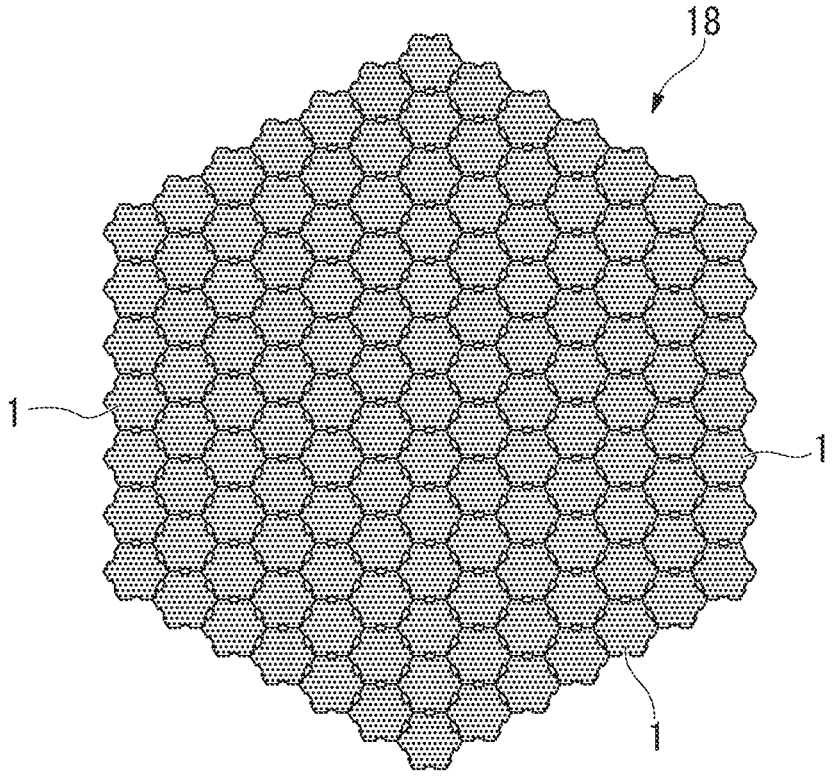
FIG. 4 is a top view showing an assembly in which spent nuclear fuel assembly storage containers are arranged in a honeycomb structure.

In the spent nuclear fuel assembly storage containers 1 according to this embodiment, the container bodies 3 are densely arranged while the outer surfaces 6*a* of the container bodies 3 are respectively brought into contact with each other. Therefore, the assembly 18 having a honeycomb structure can be formed as shown in FIG. 4.

Figure 5:
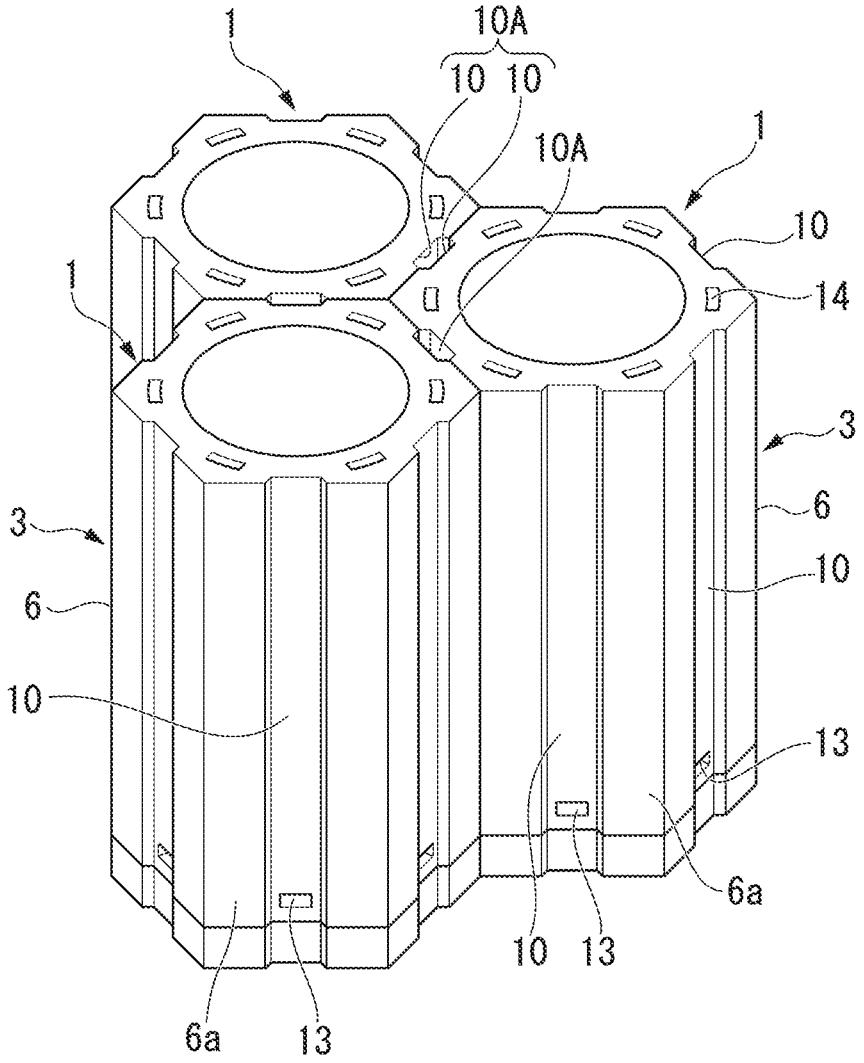
FIG. 5 is an enlarged perspective view showing a part of an arrangement state of an assembly of the spent nuclear fuel assembly storage containers shown in FIG. 4.

As shown in FIG. 5, in the assembly 18 of the spent nuclear fuel assembly storage containers 1, a first spent nuclear fuel assembly storage container 1 and a second spent nuclear fuel assembly storage container 1 come into contact with each other at the outer surfaces 6*a* to form the external cooling passage 10A using the pair of concave portions 10 provided in each outer surface 6*a*. In addition, the air supply passage 13 communicating with the internal cooling passage 12 opens to the concave portion 10 of each outer surface 6*a*.

For this reason, even in the state of the assembly 18 in which spent nuclear fuel assembly storage containers 1 are assembled such that they are in contact with each other in a honeycomb structure on the outdoor ground, external air flows from the top to the bottom inside the external cooling passage 10A formed by the pair of concave portions 10 of the adhering outer surfaces 6*a*. Then, the external air passes through the air supply passage 13 formed below the concave portion 10 of each outer surface 6*a* of each spent nuclear fuel assembly storage container 1 and flows inside the internal cooling passage 12 between the metal cask 2 and the inner surface 6*b* of the container body 3 to cool the metal cask 2. Then, the high-temperature external air obtained by heat exchange with the metal cask 2 passes through the exhaust passage 14 communicating with the upper surface 6*d* of each spent nuclear fuel assembly storage container 1 to be discharged to the outside.

Thus, the external cooling passage 10A provided in each of the six outer surfaces 6*a* of each spent nuclear fuel assembly storage container 1 and the cooling passage passing through the air supply passage 13, the internal cooling passage 12, and the exhaust passage 14 are formed even when the spent nuclear fuel assembly storage containers 1 are brought into contact with each other to form a honeycomb structure. Therefore, the metal cask 2 inside the container body 3 can be efficiently cooled.

In addition, the radiation emitted through the metal cask 2 stored inside the spent nuclear fuel assembly storage container 1 is attenuated by the concrete container body 3 surrounding the metal cask 2 and is further attenuated by the container bodies 3 of the spent nuclear fuel assembly storage containers 1 adjacent to the above spent nuclear fuel assembly storage container 1. For this reason, the amount of radiation emitted to the external air from the outer spent nuclear fuel assembly storage containers 1 of the assembly 18 can be minimized to be less than an allowable range of 1 mSv or less per year.

Figure 6:
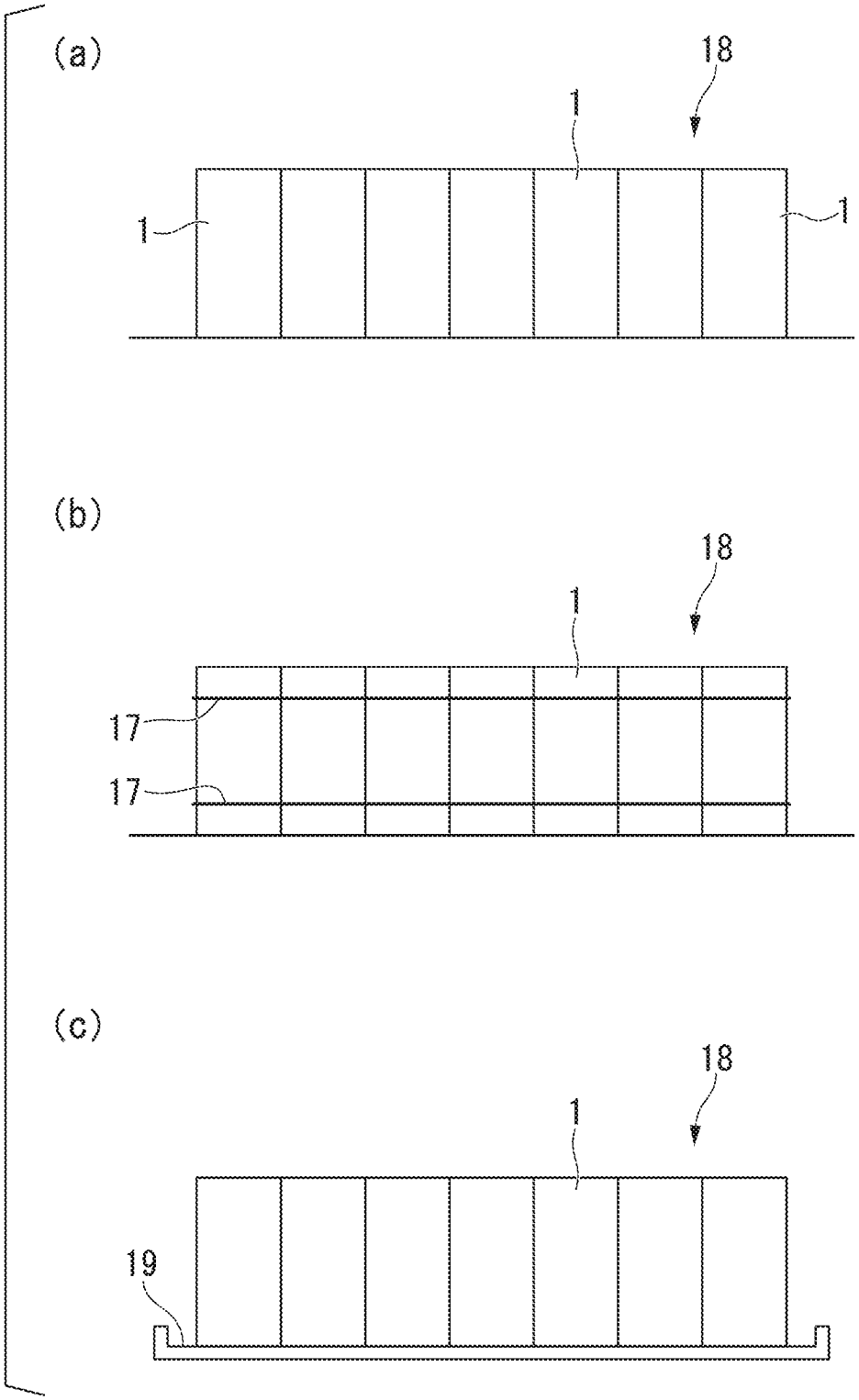
FIG. 6 is a diagram showing an arrangement state of the assembly of the spent nuclear fuel assembly storage containers on a ground, where (a) of FIG. 6 is a side view showing the assembly stored on a flat ground, (b) of FIG. 6 is a side view showing a state where the assembly is stored while being restrained by a wire, and (c) of FIG. 6 is a side cross-sectional view showing a state where the assembly is stored on a flat dish.

Further, as shown in FIG. 4 and (a) of FIG. 6, in this embodiment, the assembly 18 of the spent nuclear fuel assembly storage containers 1 is stored while they are arranged in a close contact state having a honeycomb structure in an outdoor site. For this reason, it is possible to prevent falling down of the spent nuclear fuel assembly storage containers 1 due to interference therebetween even in the event of earthquakes. As shown in (b) of FIG. 6, the assembly 18 of the spent nuclear fuel assembly storage containers 1 may be holded in an outdoor site while being restrained by a wire 17. As shown in (c) of FIG. 6, the assembly 18 of the spent nuclear fuel assembly storage containers 1 may be holded while being placed on or a flat dish-shaped member 19, a surface of a floor, or the like. In such a case, each of the spent nuclear fuel assembly storage containers 1 of the assembly 18 and the metal casks 2 stored therein do not collapse or become damaged.

Due to this, the spent nuclear fuel assembly storage container 1 according to this embodiment or the assembly 18 thereof does not need be stored in a shielded building with earthquake resistance. In addition, a rigid foundation on which a container or an assembly thereof may be placed does not need to be provided. For that reason, the spent nuclear fuel assembly storage container 1 can be easily stored and transported. Further, the spent nuclear fuel assembly storage container 1 can store the spent nuclear fuel assemblies in such a manner that the spent nuclear fuel assembly storage containers 1 are arranged to be brought into contact with each other in the horizontal direction and to overlap each other in the upward direction.

As described above, according to the assembly 18 of the spent nuclear fuel assembly storage containers 1 of this embodiment, the spent nuclear fuel assembly storage container 1 can cool the metal cask 2 using the external cooling passage 10A formed by the concave portion 10 provided in each substantially hexagonal outer surface 6*a*, the air supply passage 13 provided in the concave portion 10, the internal cooling passage 12, and the exhaust passage 14. For that reason, even when the spent nuclear fuel assembly storage containers 1 are stored as the assembly 18 to have a honeycomb structure in a close contact state, all the metal casks 2 can be cooled using the external cooling passages 10A formed by the concave portions 10 of the spent nuclear fuel assembly storage containers 1.

In addition, since the radiation emitted from the metal cask 2 is shielded by the concrete container body 3, the amount of the radiation emitted through the metal cask 2 can be attenuated. Further, since the radiation passing through the container body 3 is also shielded by the container bodies 3 of other adjacent spent nuclear fuel assembly storage containers 1, the amount of the radiation can be further attenuated. For that reason, since the annual radiation amount at a boundary between the assembly 18 and the external environment thereof can be minimized to an allowable value of 1 mSv or less, safety is ensured.

Further, since the spent nuclear fuel assembly storage containers 1 do not need to be stored while being separated from each other within a building which shields the radiation, a strong foundation ground does not need to be provided, and the spent nuclear fuel assemblies are arranged on an outdoor ground in a close contact state, the spent nuclear fuel assemblies can be easily stored and transported. Therefore, since the space occupied by the spent nuclear fuel assemblies is small, the spent nuclear fuel assemblies can be stored and transported at low cost.

In addition, the spent nuclear fuel assembly storage container 1 according to the present invention and the assembly 18 thereof are not limited to those of the above-described embodiment, and various modifications or replacements can be made without departing from the spirit of the present invention. Hereinafter, other embodiments or modified examples of the present invention will be described, but the same reference numerals will be used for components and members the same as or similar to those of the above-described embodiment.

Figure 7:
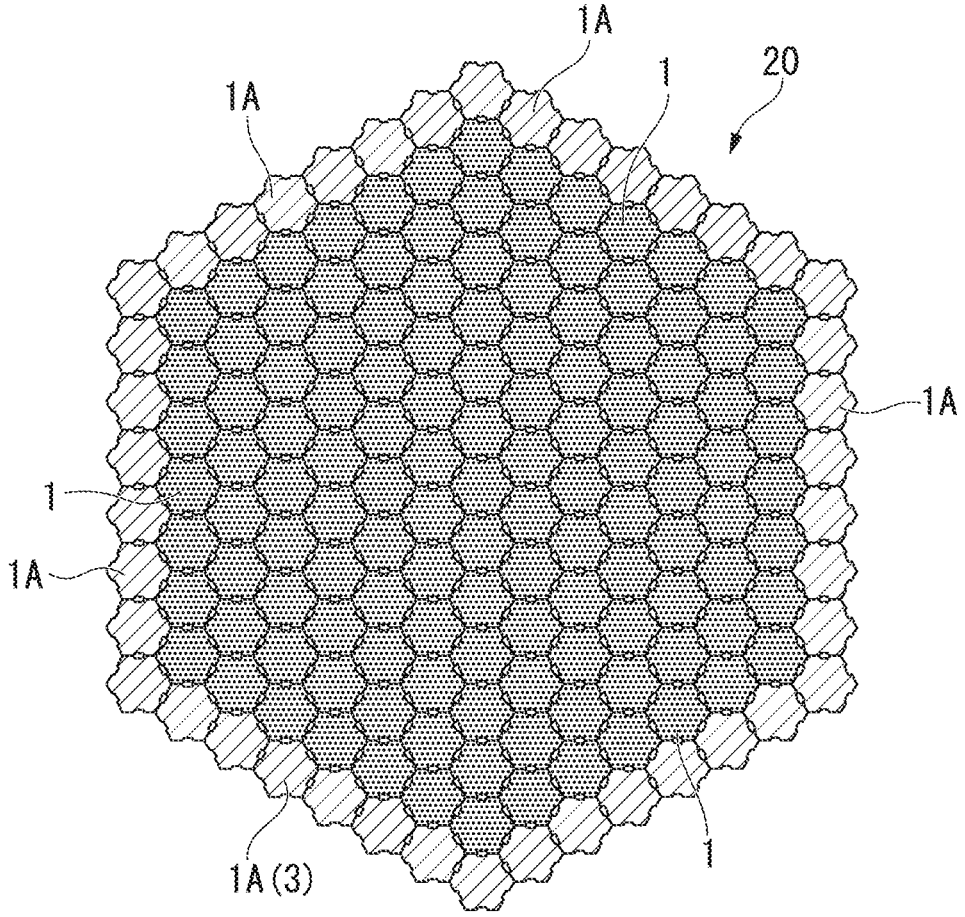
FIG. 7 is a top view showing an assembly of spent nuclear fuel assembly storage containers according to a second embodiment of the present invention, where empty container bodies are arranged outside the assembly.

Next, FIG. 7 shows an assembly 20 of the spent nuclear fuel assembly storage containers 1 according to a second embodiment of the present invention.

In FIG. 7, since the spent nuclear fuel assembly storage containers 1 are arranged in a close contact state to have a honeycomb structure, the radiation emitted from the metal cask 2 passing through the container body 3 of each of the spent nuclear fuel assembly storage containers 1 is shielded and attenuated while passing through the wall surfaces of the side cylindrical portions 6. For that reason, the radiation amount at a boundary between the assembly 20 and the external environment thereof can be reliably within an allowable value of 1 mSv or less per year.

However, in a spent nuclear fuel assembly storage container 1 disposed at the outermost side of the assembly 20, the radiation emitted from the metal cask 2 is discharged to the external environment while passing through only the wall surface of one side cylindrical portion 6. For this reason, there is a possibility that the radiation amount may be larger than the annual allowable value.

For that reason, in the second embodiment, dummy spent nuclear fuel assembly storage containers 1A including empty container bodies 3 not storing the metal casks 2 are arranged at the outermost side of the assembly 20 of the spent nuclear fuel assembly storage containers 1 so that the spent nuclear fuel assembly storage containers 1 are surrounded by the dummy spent nuclear fuel assembly storage containers 1A.

By employing such a configuration, the radiation emitted outward from a spent nuclear fuel assembly storage container 1 disposed at the outermost side in the assembly 20 of the spent nuclear fuel assembly storage containers 1 is shielded while passing through the wall surfaces of the side cylindrical portions 6 of the dummy spent nuclear fuel assembly storage containers 1A. Therefore, the annual radiation amount may be able to be brought within the allowable value of 1 mSv or less. In addition, the spent nuclear fuel assembly storage containers 1 which are disposed inside the empty spent nuclear fuel assembly storage containers 1A can be cooled by the empty spent nuclear fuel assembly storage containers 1A.

In addition, when the radiation amount is not sufficiently lowered even by a configuration in which a single row of dummy spent nuclear fuel assembly storage containers 1A are arranged at the outside of the assembly 20 to surround the spent nuclear fuel assembly storage containers 1, for example, double, triple, or multiple rows of dummy spent nuclear fuel assembly storage containers 1A may be arranged at the outside so that the annual radiation amount becomes reliably within the allowable value of 1 mSv or less.

Figure 8:
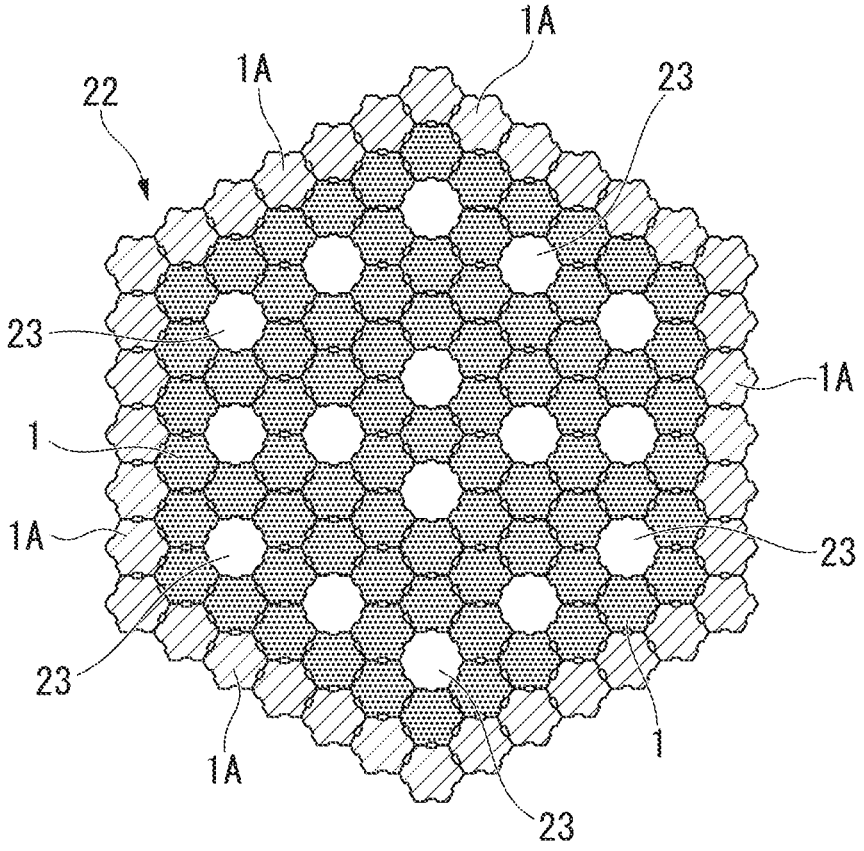
FIG. 8 is a top view showing an assembly of spent nuclear fuel assembly storage containers according to a third embodiment.

Next, FIG. 8 shows an assembly 22 of the spent nuclear fuel assembly storage containers 1 according to a third embodiment of the present invention.

In the assembly 22 of the spent nuclear fuel assembly storage containers 1 shown in FIG. 8, similarly to the second embodiment, the spent nuclear fuel assembly storage containers 1 are arranged to form a honeycomb structure in a close contact state and the outside thereof is surrounded by the dummy spent nuclear fuel assembly storage containers 1A. However, substantially hexagonal tubular spaces in which the inner spent nuclear fuel assembly storage containers 1 are removed are formed at predetermined intervals. These spaces will be referred to as void holes 23.

In this embodiment, the void holes 23 are arranged in such a manner that at least one outer surface 6*a* of each one of the substantially hexagonal tubular container bodies 3 faces the void hole 23 in spent nuclear fuel assembly storage containers 1 other than the outer spent nuclear fuel assembly storage containers 1.

Accordingly, in the spent nuclear fuel assembly storage containers 1 except for the dummy spent nuclear fuel assembly storage containers 1A, when external air passes through the external cooling passage 10A formed by the concave portion 10 in the six outer surfaces 6*a* and the internal cooling passage 12 inside the spent nuclear fuel assembly storage container 1 and flows to come into contact with the metal cask 2, the metal cask 2 can be cooled. In addition, since the external cooling passage 10A formed by the concave portion 10 communicates with the void hole 23 in six spent nuclear fuel assembly storage containers 1 facing the void hole 23, the function of cooling the metal cask 2 is further improved.

In addition, when the dummy spent nuclear fuel assembly storage containers 1A are not provided at the outside of the assembly 22 of the spent storage containers 1, the effect of cooling the metal cask 2 in the outer spent nuclear fuel assembly storage containers 1 is further improved.

Figure 9:
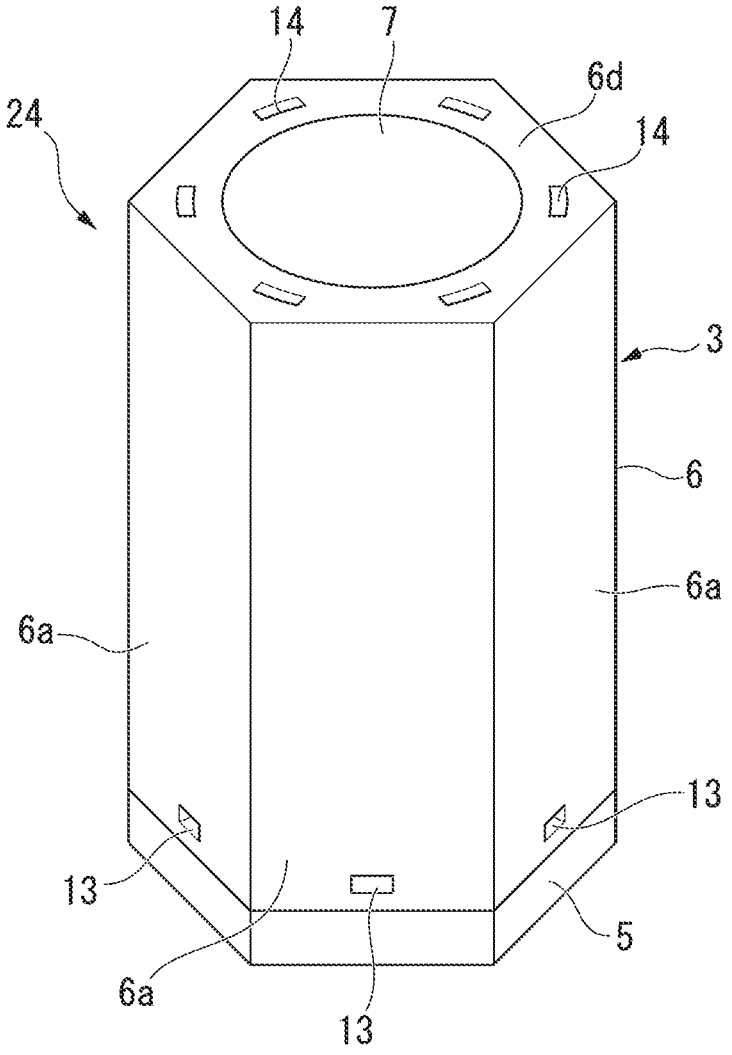
FIG. 9 is a perspective view showing a spent nuclear fuel assembly storage container according to a modified example of the third embodiment.

Further, as a modified example of the third embodiment, the dummy spent nuclear fuel assembly storage containers 1A in the assembly 22 of the spent nuclear fuel assembly storage containers 1 may be removed, and spent nuclear fuel assembly storage containers 24 shown in FIG. 9 and including container bodies 3 without concave portions 10 may be provided instead of other spent nuclear fuel assembly storage containers 1.

In this case, external air falling into the void hole 23 enters the internal cooling passage 12 from the air supply passage 13 with the air supply port provided in the outer surface 6*a* facing the void hole 23 to cool the metal cask 2, and passes through the exhaust passage 14 of the upper surface 6*d* to be discharged to the atmosphere. Thus, according to the assembly 22 of this modified example, the metal cask 2 inside the spent nuclear fuel assembly storage container 24 can be cooled without forming the concave portion 10 in the outer surface 6*a* of the container body 3.

Figure 10:
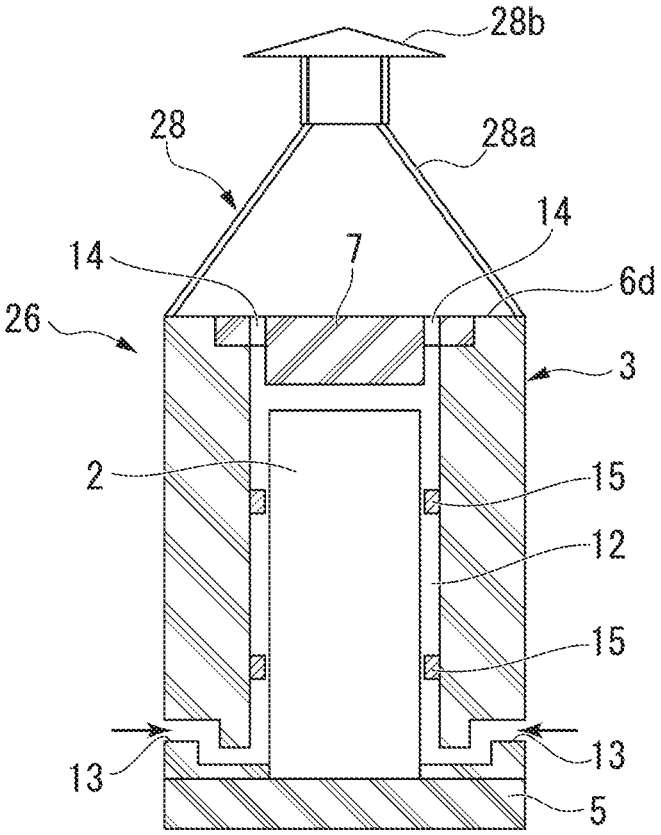
FIG. 10 is a longitudinal sectional view showing a spent nuclear fuel assembly storage container according to a fourth embodiment.

Next, a spent nuclear fuel assembly storage container 26 according to a fourth embodiment of the present invention will be described with reference to FIG. 10.

A basic configuration of the spent nuclear fuel assembly storage container 26 according to this embodiment is the same as that of the spent nuclear fuel assembly storage container 1 according to the first embodiment. However, the spent nuclear fuel assembly storage container 26 has a difference in that the exhaust passage 14 extends along a line extending from the internal cooling passage 12 and opens to the upper surface of the lid portion 7.

Further, a chimney 28 which is a cooling tower is attached to the upper surface 6*d* of the side cylindrical portion 6 of the container body 3. The chimney 28 includes a small-diameter opening portion (outlet) formed at an upper end of a roof portion 28*a* which decreases in diameter upward from a large-diameter opening portion (inlet) covering the upper surface 6*d* of the container body 3 to formed a tapered shape, and a second roof portion 28*b* formed at the upper surface.

For that reason, when an exhaust gas discharged from the opening portion of the exhaust passage 14 of the container body 3 is caused to converge by the chimney 28, the flow speed of the exhaust gas increases so that the cooling efficiency of the metal cask 2 is improved. In addition, the chimney 28 is made of steel, but may be made of concrete. Further, the chimney 28 may be integrated with or separate from the container body 3.

According to the spent nuclear fuel assembly storage container 26 of the fourth embodiment with the above-described configuration, since external air flowing into the air supply passage 13 from the air supply port of the container body 3 flows through the internal cooling passage 12 from the bottom toward the top, the outer peripheral surface of the metal cask 2 can be efficiently cooled.

In addition, the chimney 28 is provided in the upper surface 6*d* of the container body 3 so that the external air is discharged from the exhaust port of the exhaust passage 14 to the chimney 28 at a high flow speed. Therefore, the flow speed of the internal cooling passage 12 is further increased and thus the effect of cooling the metal cask 2 can be further improved.

Further, concrete capable of shielding radiation is used as a material of the container body 3 storing the metal cask 2 by the spent nuclear fuel assembly storage container 1. As concrete capable of shielding radiation, various types of concrete including ordinary concrete using Portland cement and the like can be used. In particular, it is preferable to use concrete having a high neutron shielding performance among radiation shielding performances for the container body 3. In this embodiment, the neutron shielding concrete used as the material of the container body 3 will be described below.

The neutron shielding concrete according to this embodiment includes a boron-based boron aggregate such as colemanite and/or hilgardite selected from ores of an evaporation type sedimentary deposit and cement which is a consolidating material and is manufactured by mixing the cement with colemanite and/or hilgardite corresponding to the aggregate except for eurekite and sassolite contained in the ores of the evaporation type sedimentary deposit.

Further, since ulexite and sassolite contained in ores of an evaporation type sedimentary deposit easily dissolve in water and may dissolve in water beforehand to inhibit the hydration reaction of cement, colemanite and/or hilgardite may not be easily solidified with the cement. However, according to the above-described neutron shielding concrete, when colemanite or hilgardite which is a boron mineral selected and collected from the ores of the evaporation type sedimentary deposit is kneaded and mixed with cement except for eurekite and sassolite contained in the ores of the evaporation type deposit, it is possible to obtain a boron-containing concrete having high strength, high durability, and sufficient neutron shielding performance.

This neutron shielding concrete is disclosed in detail in Japanese Patent Application No. 2013-272471 proposed by the present inventor.

Further, as other kinds of concrete having high radiation shielding performance, concrete (G-concrete) having high specific gravity of 3.5 or more can be used. This high specific gravity concrete mainly includes heavy aggregates such as sand, gravel, magnetite, iron ore, iron oxide powder, and oxidized slag.

In the spent nuclear fuel assembly storage container 1 according to this embodiment, the container body 3 is made of the above-described boron-containing concrete including boron minerals or high specific gravity concrete having a specific gravity of 3.5 or more or is made by applying or laminating boron-containing concrete or high specific gravity concrete to an outer or inner surface of ordinary concrete.

When such concrete is used as the material of the container body 3, it is possible to reduce the transmission amount of the radiation emitted from the metal cask 2 by shielding the radiation and to minimize the radiation amount at the boundary between the assembly 18 and the external environment thereof to 1 mSv or less per year.

Figure 11:
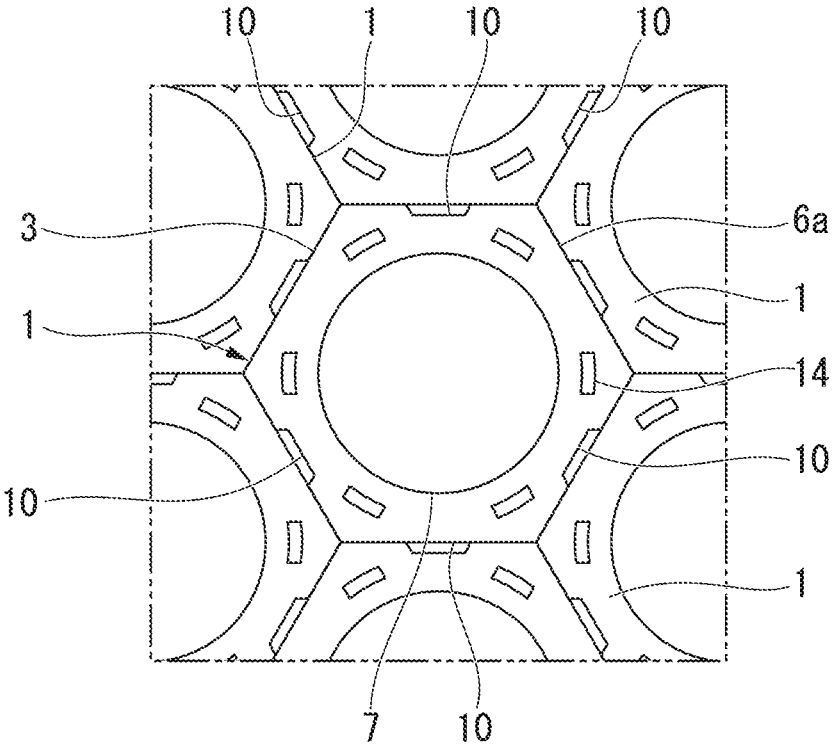
FIG. 11 is a partially enlarged top view showing a modified example of an assembly of spent nuclear fuel assembly storage containers.

In addition, in the above-described first embodiment, the side cylindrical portion 6 of the spent nuclear fuel assembly storage container 1 is formed in a hexagonal tubular shape and each outer surface 6*a* is provided with the concave portion 10. Accordingly, when adjacent spent nuclear fuel assembly storage containers 1 are brought into contact with each other, the external cooling passage 10A having a substantially hexagonal tubular shape is formed between the concave portions 10. However, instead of this configuration, when the concave portion 10 is provided on one outer surface 6*a* of the spent nuclear fuel assembly storage containers 1 which come into contact with each other as shown in FIG. 11, the external cooling passage 10A communicating with the air supply passage 13 can be formed.

Further, the air supply passage 13 and the exhaust passage 14 communicating with the internal cooling passage 12 or the external cooling passage 10A may not be formed in all six surfaces of the container body 3 and may be formed in at least one of six surfaces.

Further, in the present invention, the spent nuclear fuel assembly storage container 1 may be provided with any one of the external cooling passage 10A formed by the concave portion 10 of the outer surface 6*a* of the container body 3 and the internal cooling passage 12 formed between the metal cask 2 and the inner surface 6*b* of the container body 3.

When the external cooling passage 10A is provided by the concave portion 10, the metal cask 2 can be indirectly cooled through the container body 3 by the external air flowing in the concave portion 10. Further, when the chimney 28 is provided in the upper surface 6*d* of the container body 3, the circulation of external air in the external cooling passage 10A flows faster. Therefore, the cooling effect can be improved.

Further, when the internal cooling passage 12 is provided, the metal cask 2 can be directly cooled by the external air flowing through the air supply passage 13 and the exhaust passage 14.

INDUSTRIAL APPLICABILITY

According to the assembly of the spent nuclear fuel assembly storage containers of the present invention, a large number of storage containers can be disposed in a small occupied space, the amount of the radiation emitted to the outside can be reduced to the allowable value or less, and the cooling effect can be improved.

REFERENCE SIGNS LIST

1, 24, 26 Spent nuclear fuel assembly storage container
1A Dummy spent nuclear fuel assembly storage container
2 Metal cask
3 Container body
5 Base
6 Side cylindrical portion
6*a* Outer surface
6*b* Inner surface
6*d* Upper surface
10 Concave portion (external cooling passage)
10A External cooling passage
12 Internal cooling passage
13 Air supply passage
14 Exhaust passage
15 Stopper
18, 20 Assembly
23 Void hole
27 Fin
28 Chimney

The invention claimed is:

1. A spent nuclear fuel assembly storage container comprising:

a metal cask which stores a spent nuclear fuel assembly therein;

a container body which stores the metal cask and has a substantially hexagonal tubular shape; and a concave portion which is formed on an outer surface of the container body having the substantially hexagonal tubular shape, is recessed inward, and extends in a longitudinal direction, wherein the concave portion forms an external cooling passage for a cooling gas when an outer surface of the container body is joined to an outer surface of another container body.

2. The spent nuclear fuel assembly storage container according to claim 1, wherein an inner surface of the container body is provided with a stopper which prevents vibration of the metal cask.

3. The spent nuclear fuel assembly storage container according to claim 1, wherein an upper surface of the container body is provided with a tapered chimney.

4. The spent nuclear fuel assembly storage container according to claim 1, wherein the container body is made of heavy-weight concrete having a specific gravity of 3.5 or more.

5. A spent nuclear fuel assembly storage container comprising:

a metal cask which stores a spent nuclear fuel assembly;

a container body which stores the metal cask and has a substantially hexagonal tubular shape; and an internal cooling passage which is provided between the metal cask and an inner surface of the container body and is provided with a cooling gas supply passage and an exhaust passage communicating with external air at upper and lower portions thereof.

6. The spent nuclear fuel assembly storage container according to claim 5, wherein an inner surface of the container body is provided with a stopper which prevents vibration of the metal cask.

7. The spent nuclear fuel assembly storage container according to claim 5, wherein an upper surface of the container body is provided with a tapered chimney.

8. The spent nuclear fuel assembly storage container according to claim 5, wherein the container body is made of heavy-weight concrete having a specific gravity of 3.5 or more.

9. A spent nuclear fuel assembly storage container comprising:

a metal cask which stores a spent nuclear fuel assembly; and a container body which stores the metal cask and has a substantially hexagonal tubular shape, wherein the container body is made of neutron shielding concrete including an aggregate mainly including colemanite and/or hilgardite collected from an ore of an evaporation type sedimentary deposit and a cement which is a consolidating material and is manufactured by mixing the cement with the colemanite and/or hilgardite as an aggregate excluding ulexite and sassolite contained in the ore of the evaporation type sedimentary deposit.

10. An assembly of spent nuclear fuel assembly storage containers in which spent nuclear fuel assembly storage containers each including a metal cask storing a spent nuclear fuel assembly and a container body storing the metal cask and having a substantially hexagonal tubular outer surface are arranged, wherein the container bodies are arranged to have a honeycomb structure while the outer surfaces are brought into contact with each other, and wherein a space without the spent nuclear fuel assembly storage container is provided in such a manner that at least one outer surface of the bodies contacts external air.

11. An assembly of spent nuclear fuel assembly storage containers in which spent nuclear fuel assembly storage containers each including a metal cask storing a spent nuclear fuel assembly and a container body storing the metal cask and having a substantially hexagonal tubular outer surface are arranged, wherein the container bodies are arranged to have a honeycomb structure while the outer surfaces are brought into contact with each other, and wherein container bodies not storing the metal casks are arranged at a further outside of spent nuclear fuel assembly storage containers arranged at an outside of the spent nuclear fuel assembly storage containers.

* * * * *